US010228146B2

(12) United States Patent
Zenker et al.

(10) Patent No.: US 10,228,146 B2
(45) Date of Patent: Mar. 12, 2019

(54) COOKING APPARATUS HAVING LIGHTING ELEMENTS

(71) Applicant: SCHOTT AG, Mainz (DE)

(72) Inventors: Thomas Zenker, Nieder-Olm (DE); Gerold Ohl, Sulzheim (DE); Bernd Woelfing, Mainz (DE); Ju-Young Uam, Frankfurt am Main (DE); Martin Taplan, Mainz (DE)

(73) Assignee: SCHOTT AG, Mainz (DE)

( * ) Notice: Subject to any disclaimer, the term of this patent is extended or adjusted under 35 U.S.C. 154(b) by 108 days.

(21) Appl. No.: 14/332,432

(22) Filed: Jul. 16, 2014

(65) Prior Publication Data

US 2015/0021312 A1 Jan. 22, 2015

(30) Foreign Application Priority Data

Jul. 16, 2013 (DE) ..... 10 2013 107 523
Sep. 18, 2013 (DE) ..... 10 2013 110 277

(51) Int. Cl.

| | |
|---|---|
| ***H05B 3/68*** | (2006.01) |
| ***F24C 7/08*** | (2006.01) |
| ***F24C 15/10*** | (2006.01) |
| ***H05B 3/74*** | (2006.01) |
| ***F24C 7/06*** | (2006.01) |
| ***H05B 6/12*** | (2006.01) |

(52) U.S. Cl.

CPC ..... *F24C 7/083* (2013.01); *F24C 7/067* (2013.01); *F24C 15/105* (2013.01); *H05B 3/74* (2013.01); *H05B 3/746* (2013.01); *H05B 6/12* (2013.01); *H05B 2206/022* (2013.01)

(58) Field of Classification Search

CPC ..... F24C 15/105; F24C 7/067; F24C 7/083; H05B 2206/022; H05B 3/74; H05B 3/746; H05B 6/12

USPC ..... 219/443.1–468.2

See application file for complete search history.

(56) References Cited

U.S. PATENT DOCUMENTS

| | | | | |
|---|---|---|---|---|
| 5,103,077 | A | 4/1992 | Goessler et al. | |
| 5,977,522 | A | 11/1999 | Henrich et al. | |
| 6,300,602 | B1 | 10/2001 | Platt et al. | |
| 7,718,929 | B2 * | 5/2010 | Shimatani | C03C 17/06 219/443.1 |
| 7,763,832 | B2 * | 7/2010 | Striegler | C03C 8/18 219/448.11 |

(Continued)

FOREIGN PATENT DOCUMENTS

| | | |
|---|---|---|
| DE | 3613902 | 10/1987 |
| DE | 3831233 A1 | 3/1990 |

(Continued)

*Primary Examiner* — Sang Y Paik

(74) *Attorney, Agent, or Firm* — Ohlandt, Greeley, Ruggiero & Perle, L.L.P.

(57) ABSTRACT

A cooking apparatus with a cooktop composed of a glass or glass-ceramic material is provided. The cooking apparatus includes a heating element and a lighting element that are disposed in the region below the underside of the cooktop. The heating element is applied to the underside of the cooktop indirectly by a pressing device or directly by pre-stressing one or a plurality of spring elements. The lighting element and the heating element are disposed on a common support section of the pressing device in such a way that they are adjustable with an oscillation of the cooktop.

27 Claims, 13 Drawing Sheets

(56) References Cited

U.S. PATENT DOCUMENTS

| | | | | |
|---|---|---|---|---|
| 2003/0006230 | A1* | 1/2003 | Kaji | G02B 6/001 219/620 |
| 2006/0091135 | A1* | 5/2006 | Kondo | H05B 6/1218 219/621 |
| 2007/0295711 | A1 | 12/2007 | Striegler | |
| 2010/0065550 | A1* | 3/2010 | Tominaga | H05B 6/062 219/622 |
| 2011/0073588 | A1* | 3/2011 | Kusaka | H05B 6/062 219/621 |
| 2011/0226231 | A1 | 9/2011 | Siebers et al. | |
| 2012/0118870 | A1 | 5/2012 | Shigeoka | |
| 2012/0138596 | A1 | 6/2012 | Alonso Esteban | |
| 2012/0223070 | A1* | 9/2012 | Matsui | H05B 6/1254 219/677 |
| 2013/0220298 | A1* | 8/2013 | Motabar | F24C 15/10 126/213 |
| 2013/0273320 | A1 | 10/2013 | Bockmeyer | |
| 2013/0286630 | A1* | 10/2013 | Guiset | F24C 7/083 362/23.1 |
| 2014/0146538 | A1 | 5/2014 | Zenker et al. | |

FOREIGN PATENT DOCUMENTS

| | | | |
|---|---|---|---|
| DE | 3835735 | | 4/1990 |
| DE | 4002322 | A1 | 8/1991 |
| DE | 4004309 | | 8/1991 |
| DE | 4105627 | | 8/1992 |
| DE | 9302894 | | 4/1993 |
| DE | 4335893 | A1 | 4/1994 |
| DE | 19651859 | | 12/1997 |
| DE | 10004446 | | 8/2001 |
| DE | 60117942 | | 9/2006 |
| DE | 202008017803 | | 8/2010 |
| DE | 202010014361 | | 12/2010 |
| DE | 102010061123 | | 6/2012 |
| DE | 102011050878 | | 6/2012 |
| DE | 102011050870 | | 12/2012 |
| DE | 102011115379 | | 4/2013 |
| EP | 1213543 | | 6/2002 |
| EP | 1867613 | | 12/2007 |
| JP | 2007139246 | | 6/2007 |
| JP | 2010257579 | | 11/2010 |
| JP | 2012226850 | | 11/2012 |
| WO | 2011010428 | | 1/2011 |
| WO | 2011020720 | | 2/2011 |

* cited by examiner

COOKING APPARATUS HAVING LIGHTING ELEMENTS

CROSS REFERENCE TO RELATED APPLICATIONS

This application claims benefit under 35 U.S.C. § 119(a) of German Patent Application No. DE 10 2013 107 523.1 filed on Jul. 16, 2013 and German Patent Application No. DE 10 2013 110 277.8 filed on Sep. 18, 2013, the entire contents of both of which are incorporated herein by reference.

BACKGROUND

1. Field of the Disclosure

The invention relates to a cooking apparatus with a cooktop composed of a glass or glass-ceramic material, wherein at least one heating element and at least one lighting element are disposed in the region below the underside of the cooktop, wherein the heating element is applied to the underside of the cooktop by means of a spring-action pressing device, directly or indirectly, for example, by pre-stressing one or more spring elements or spring-action fixtures or mounting plates.

2. Description of Related Art

Cooking apparatuses having lighting elements in which the lighting elements are used for the display of operating states are known from the prior art. Induction cooking apparatuses are usually designed today with a glass-ceramic panel as the cooktop. Basically, other materials such as pre-stressed soda-lime glass or borosilicate glass, for example, can also be employed as cooktop material, if a thermal overheating of these materials that are more sensitive to temperature can be avoided. All materials, glass ceramics as well as soda-lime glass or borosilicate glass, are brittle-fracture materials. In order to avoid glass breaks during assembly, transport, or in the operation of the cooking apparatus in the kitchen, structural measures must be considered so that a break in the cooktop is avoided. A glass cooktop or a glass-ceramic cooktop cannot equilibrate the energy of a falling pot by means of deformation of the surface, as a metal surface could, for example. Rather, the energy must be dissipated into the environment by oscillations. If this dissipation is prevented, then the impact load leads to a break of the cooktop. For this reason, cooktops are incorporated in such a way that they can evade impact loads, for example, when a pot falls onto the cooktop. The heating elements, in particular, induction coils, are pressed by spring action to the underside of the cooktop; thus these elements can also yield in the case of an impact load.

Lighting elements serve for marking cooking zones or for visualizing operating states, such as cooking conditions or hazardous circumstances. In order to assure easy identification, the lighting elements should be brought as closely as possible to the underside of the cooktop. Then losses due to scattering are kept small and a good image sharpness and brightness of the lighting elements can be achieved. The lighting elements themselves can be glass or glass ceramics, and therefore have the property that the light output along the length of the lighting element can be defined as needed. In the case of an impact load (falling pot) onto the cooktop, there is now a double risk in this case. On the one hand, the cooktop can strike the lighting element and break during the deflection. On the other hand, however, the lighting element can also be damaged, or both components can be rendered unusable simultaneously by the impact.

A cooking apparatus in which a heating element is disposed underneath the cooktop is known from DE 38 31 233 A1. In this case, the heating element is supported by a housing. A housing extension is screwed onto the housing laterally. The housing extension supports a lighting means, which couples its light into a lighting element formed as a light guide. The light guide is thus formed ring-shaped and surrounds the heating element.

Another cooking apparatus is known from DE 40 02 322 A1. Just like in the case of DE 38 31 233 A1, an annular light guide is used here as a lighting means. This light guide is embedded in the insulating material of the heating element.

Another ring-shaped or annular light guide is known from DE 43 35 893 A1.

SUMMARY

The object of the invention is to provide a cooking apparatus of the type mentioned above, in which operating safety is improved.

This object is achieved in that the lighting element or lighting elements and the at least one heating element are disposed on a common support section of the pressing device in such a way that they can be adjusted by a deflection and/or oscillation of the cooktop.

In the case of an impact load, the lighting element can now be deflected jointly with the heating element in order to make possible an oscillation of the cooktop. On the one hand, the danger of breaking the cooktop can be reduced in this way. On the other hand, however, the lighting element is also protected from damage. Due to the fact that the lighting element and the heating element are disposed on a common support section of the pressing device, a simple construction will also be provided, which can be manufactured with low cost for parts and assembly. The construction of the cooking apparatus can be selected, in particular, in the scope of the invention, such that the lighting elements are mounted in a fixed position relative to the heating element.

Preferably, the construction according to the invention is individualized such that at least one spring element loading the pressing device can be deflected in the case of a displacement of the lighting element and the heating element. In this way, damage to the lighting element due to an impacting of the cooktop will be excluded.

According to a variation of the invention, it can be provided that at least one spring element loading the pressing device can be deflected in the case of a displacement of the lighting element and of the heating element. In particular, the above-mentioned fixed arrangement of the lighting element relative to the heating element can find use in this way, whereby the distance between the lighting element and the underside of the cooktop does not change in the case of an impact or bending load. For this purpose, it can also be provided that the support section itself is formed in a spring-elastic manner.

Additionally or alternatively, it can also be provided that the lighting element is supported in a spring-loaded pre-stressed manner relative to the pressing device. With the spring elements supporting the lighting element relative to the pressing device and the spring elements that pre-stress the support section of the pressing device, an individual adaptation to the selected cooktop can be conducted via a suitable selection of the spring constants.

It is preferably provided that the lighting element is disposed at a distance to the underside of the cooktop, whereby, preferably, a distance in the range of 0.2 to 10 mm, particularly preferred 0.5 to 5 mm, more particularly preferred 0.5 to 2 mm is provided. As a consequence of the distancing and the spring pre-stressing of the support section, an impacting of the cooktop onto the lighting element is reliably prevented. The distance range between 0.5 mm and 5 mm with simultaneous safety against damage, in particular in the case of large-size colored glass or glass-ceramic materials, guarantees a sufficiently high light output for the cooktop in order to visualize a display on the front side of the cooktop. For normal-size to small-size cooktops, the distance range can be decreased to 0.5 to 2 mm. A distance range of up to 10 mm can be provided, if large deflections/displacements are expected, for example, in the case of large formats that are mounted so that they can be simultaneously oscillated.

According to one variation of the invention, it can be provided that the support section bears several heating elements, whereby the heating elements are disposed in at least one row. With this arrangement, the structural expenditure for a cooking apparatus can be clearly simplified. It can also be provided thereby that several support sections that extend in the directions of width or depth are disposed underneath the cooktop. In this way, in particular, an induction cooking apparatus can be constructed, in which the entire cooktop is loaded with heating elements in order to be able to carry out a freely selectable positioning of a pot on the cooktop.

If it is provided that the support section is part of a support that incorporates the at least one heating element and the at least one lighting element, then a uniform subassembly will be formed, which can be installed with low cost. In the case of maintenance, this subassembly can also be replaced in a targeted manner.

In this way, a further optimizing of the support can be achieved in that it is formed as a housing and has at least one lateral shaped uptake for the lighting element. For the same purpose, the support may also have another structure; for example, it can be shaped as a disk or panel.

Particularly preferred, the heating element and the lighting element can be electrified at a common electrical connection of the support. In this way, a concise and simple contacting of the heating elements will be possible.

A conceivable variation of the invention is one where the lighting element is disposed between two heating elements.

If a cooking apparatus according to the invention is configured such that the lighting element has a lighting means and a light guide having at least one light guide segment, into which the lighting means couples its light, and that the light guide segment or another light guide segment coupled with the first light guide segment has an emission region over which the light of the lighting means can be emitted in the direction onto the underside of the cooktop, then individual illumination situations can be produced in a targeted manner. In particular, the temperature-sensitive lighting means also can be disposed away from the heating elements. Punctiform or flat-surface lighting effects can be configured with the light guide segments.

If it is provided that the at least two light guide segments transition into one another, making up one piece via a bending or angulation, then first of all, a low cost for parts and assembly can be achieved via the one-piece formation. Also, spatially difficultly accessible regions underneath the cooktop can also be made accessible by means of the light guide segments. In addition, optical mounts that label a cooking-zone region, for example, for an observer, can be produced by means of the two light guide segments arranged at an angle to one another.

The emission region of the lighting elements can be formed by a convex surface or a planar surface of the light guide segment. In particular, well-recognizable lighting effects that have not been known previously in the prior art can be produced via planar surfaces. For further improvement of the lighting effects, a light-scattering element, for example, a light-scattering plane, can be introduced on the underside of the cooktop, for example in the form of a roughening, a coating, in particular an organic or ceramic coating, a scattering element, for example, a scattering foil, a small scattering glass or ceramic plate or a scattering plastic film. The aforementioned coatings can be formed, for example, with the use of: sol-gel materials, silicones, silicone resins, epoxy resins, methacrylates, polyurethane. (Color) pigments or dispersed particles can be used as ceramic components. As mentioned above, the light-scattering element can be an indirect support or can have such a support. Examples of indirect supports are glasses, glass ceramics or foils, which in turn can be provided with organic and/or ceramic coatings.

The indirect support of the light-scattering layer can be joined to the underside either self-adhesively, cohesively (for example, with an adhesive layer) or loosely via pressing forces. In particular, in combination with locally limited lighting effects, which are limited, for example, via a masking on the underside of the cooktop, the light-scattering element brings about a widening of the observation angle (compare FIG. 16 and FIG. 17) and a reduction of the parallax shift, whereby the recognition of this lighting effect is essentially improved for the user. The following materials can be used, for example, as scattering materials: Lexan 8B28 (SABIC Innovative Plastics), Macrofol BL/LT (Bayer), Plexiglas SATINICE (Röhm), OPALIKA Glas (SCHOTT).

In this way, it can also be provided that at least one of the light guide segments is formed as a flat surface element.

A cooking apparatus according to the invention can be configured such that the average transmission of the colored cooktop is >0.1%, preferably >0.4%, in each case for at least one, preferably for each of the spectral regions from 420 to 500 nm, 500 to 550 nm, and 550 to 640 nm. Sufficiently bright color perceptions in the blue to red spectral region can be evoked in this way with the lighting elements through the cooktop onto the display side formed by the front side of the cooktop. With an average transmission of >0.4%, clearly recognizable and sufficiently bright displays can be created in this way. In order to preclude a view into the inner structure of the cooking apparatus and to present an esthetic, preferably colored, uniform, non-transparent cooktop, the maximum transmission of the cooktop should be defined at <50%, preferably <25% at 400 nm-700 nm, whereby, additionally, the transmission in the spectral region from 450-600 nm should amount to <8%, preferably <4%. With a maximum transmission of <25%, the view is also prevented in the case of light irradiation from outside.

According to the invention, it can also be provided that an optical compensation filter is disposed between the upper side of the cooktop and the lighting element. Such an optical compensation filter shifts the light location of the lighting effect emitted by the lighting element. With the use of colored glass ceramics, the light location is then shifted once more in the passage through the cooktop. The optical compensation filter can now be adapted to the material of the cooktop in such a way that finally the desired color effect can be produced on the display side of the cooktop. Particularly inexpensive lighting elements can be employed in this case, with the use of LEDs, for example. Filter foils can be used as the optical compensation filter, or suitable filter materials can be coated directly onto the underside of the cooktop or can be disposed directly in front of the lighting element/the LED or can be integrated into the light guide or introduced on the light guide. The compensation filter additionally can also be created such that it produces a scattering effect and thus a widening of the observation angle.

A cooking apparatus according to the invention can also be one wherein the cooktop is provided with a coating in the region of its upper side and/or underside. The coating can thus have functional properties; for example, in the case of a transparent or partially transparent cooktop, it prevents a view onto the fittings disposed under the cooktop. Additionally or alternatively, the coating can also be used for optical decoration. The coating can also be provided with recesses, in particular in the region of the lighting elements, so that it forms a masking.

Cooktops are known from the prior art, which, for purposes of strength, are provided with a knobby or similar structuring in the region of their underside. In order to be able to obtain an improved display quality in the case of such cooktops, it can be provided that a filler layer of transparent material is introduced onto the underside of the cooktop, at least in portions of the emission surface. In this way, the scattering effects of the structured underside will be reduced or completely eliminated. The filler layer may be composed of a transparent or translucent (for example, even scattering) plastic, for example; it may also be composed of silicone. In order to reduce the cost of parts, however, it can also be provided that cooktops are used that are smooth on their underside, thus not structured; in particular, they are not knobby.

In the case of induction cooking apparatuses, the induction coil may particularly comprise a copper coil, including a holder (which is for the most part formed of plastic). Additionally, a temperature sensor or electrical insulation, or optionally thermal insulation, can also be associated with the induction coil. In the scope of the invention, the cooking apparatus may also be equipped with a heating element in the form of an electrical radiant heating unit or with a gas burner. Combination units having different types of heating in one appliance are also conceivable. In addition, the invention can also be applied to grilling appliances or warming appliances, which are also cooking apparatuses in the scope of the invention.

The lighting element may be composed of a light guide, a light guide holder and a lighting means. The light guide may be formed of soda-lime glass, borosilicate glass, quartz, glass ceramics, or other transparent, particularly highly transparent, types of glass. Such materials are preferred, if a lighting/display is to be achieved in the hot region of the cooktop. Depending on the ambient temperature, use of transparent or colored plastics, such as Plexiglas, salts or fluids, for example, as the light guide is also conceivable. The light input into the light guide can usually be produced by means of LEDs, which are available as common commercial LEDs in the colors of white, blue, red, and other colors. In addition, RGB-LEDs can also be utilized for producing any mixed colors. Instead of RGB-LEDs, the use of two LEDs of different colors may also be provided, these LEDs together emitting into the light guide, in order to produce a pre-specified mixed color in a targeted manner. It is also conceivable that LEDs of different colors emit their light from two different sites in the light guide in order to illuminate the latter in different colors. It is also conceivable to utilize specially adapted LEDs that extensively compensate for a shift in color through the colored cooktop, so that the desired color will be visible on the upper side of the cooktop. This may be the original color of the LED, but it can also be a color different from the original light source. It is also conceivable to place a color filter directly in front of the light source or to configure the lighting element correspondingly as a filter. In this way, in particular, the task can also be fulfilled, according to which the color shift can be varied through the colored cooktop; in particular, it can be compensated, whereby, in particular, the original color of the LED is again produced, or another color shade is produced in a targeted manner.

BRIEF DESCRIPTION OF THE DRAWINGS

The invention will be explained in more detail below based on the exemplary embodiments shown in the drawings. Herein.

DETAILED DESCRIPTION

Figure 1:
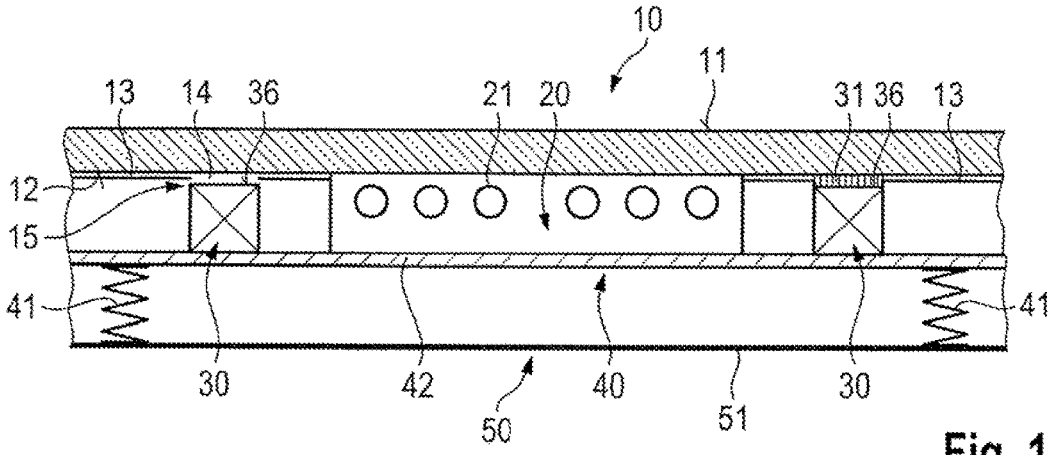
FIG. 1 shows a cooking apparatus in lateral view and in partial section in a symbolized representation.

FIG. 1 shows a cooktop 10, which is preferably designed as colored glass ceramics. It has an upper side 11 and an underside 12. A coating 13, which prevents a viewing onto the components disposed in the region below the underside 12 of the cooktop, is introduced in the region of the underside 12. The coating 13 in part has discontinuities 14, which serve as light passages. Therefore, the coating 13 forms a masking. The cooktop 10 is formed of a transparent glass material or glass ceramics. It can be colored in order to achieve appropriate esthetic optics. In this case, the coloring can also be selected such that a view through the glass ceramics is substantially prevented. In this case, coating 13 on the back side can be omitted. Heating elements 20 are disposed in the region below the underside 12 of the cooktop 10. A heating element 20 having an induction coil 21 is shown as an example in FIG. 1. The heating element 20 is mounted on a support section 42 of a pressing device 40. The support section 42 is supported on a housing 50 via spring elements 41. The support section 42 in the present case is supported by means of the spring elements 41 against a housing base 51 of the housing 50.

In addition, lighting elements 30 are mounted on the support section 42. The lighting elements 30 are disposed so that a spacing is formed between the underside 12 of the cooktop 10 and the lighting element 30. Preferably, the spacing is selected here in the range between 0.2 and 10 mm, preferably in the range of 0.5 to 5 mm, particularly in the range between 0.5 and 2 mm. The lighting elements 30 are positioned so that their emission region 36 is disposed in the region of the discontinuity 14 of the coating 13. While the left lighting element 30 inputs its lighting effect directly into the cooktop 10 via the emission region 36, in the case of the right lighting element 30, an optical compensation filter and/or an immersion layer 31 is disposed between the underside 12 of the cooktop 10 and the lighting element 30. The lighting effect of the lighting element 30 can be changed with the optical compensation filter or the immersion layer 31.

The cooktop 10 is elastically bonded on the edge into a frame or is adhered with mounting brackets, which are joined to the housing 50 by screws, locks, or the like. In this case, the arrangement is such that the cooktop 10 is supported spring-elastically relative to the housing 50. Now, if an impact load acts on the upper side 11 of the cooktop 10, then the cooktop is flexed and can oscillate relative to the housing. With this oscillating process, the heating element 20, which is pressed against the underside 12 of the cooktop 10 is also deflected. Since the lighting elements 30 are positioned in fixed arrangement relative to the heating element 20 on the support section 42, they oscillate back along with the heating element 20 against the pre-stressing of the springs 41. In this way, the support section 42 is adjusted against the spring elements 41 in the direction of the housing depth. As a consequence of the distancing of the lighting elements 30 relative to the underside 12 of the cooktop 10 and with the deflectable support section 42, an impacting of the underside 12 on the lighting elements 30 is reliably prevented. Therefore, a damaging of the lighting element(s) 30 can be excluded in practical terms. According to the invention, the support section 42 itself may have a spring effect. In this case, the use of additional springs can be omitted.

Figure 2:
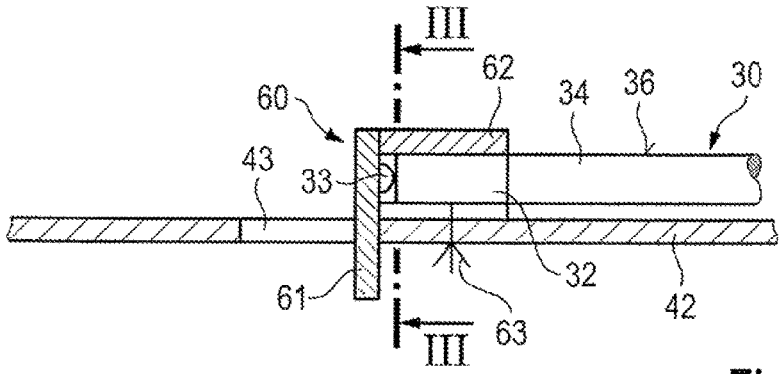
FIG. 2 shows a detail of a cooking apparatus having a support section and a lighting element mounted thereon in lateral view and in section.

An exemplary embodiment for attaching the lighting element 30 to the support section 42 is shown in FIG. 2. Here, a holder 60 is used, which has a fastening piece 61, which can be designed, for example, in the form of a printed circuit board. A retaining piece 62 is attached to the fastening piece 61. In addition, the fastening piece 61 bears a lighting means 33 of the lighting element 30. The fastening piece 61 is equipped with a contact region that maintains an electrical contacting relative to the voltage supply of the lighting element 30 in the region of the underside of the support section 42. For this purpose, the support section 42 is provided with a discontinuity 43, through which the fastening piece 61 projects. A connection 63 is provided for attaching the holder 60 to the support section 42. For example, the support section 42 can be composed of a sheet metal. The connection 63, by which the retaining piece 62 is joined to the surface of the support section 42 can be made, for example, by welding, a screw connection, or bonding. The retaining piece 62 forms an uptake into which a light guide of the lighting element 30 can be inserted. For this purpose, the light guide has a coupling piece 32, which is introduced into the retaining piece 62. A light guide segment 34 connects to the coupling piece 32. As can be recognized in FIG. 2, the light guide segment 34 of the lighting element 30 is formed by a rod-shaped material with circular cross section. For example, the lighting element 30 can be a glass rod. On the front side, the lighting means 33 couples its light into the coupling piece 32, and from there the light reaches into the region of the light guide segment 34. In the region facing the underside 12 of the cooktop 10, the lighting element 30 has its emission region 36. Here, the light of the lighting means 33 is decoupled from the light guide segment 34. In this case, the decoupling can be carried out, for example, via suitable measures, e.g., an etching of the surface of the light guide segment 34. It is also conceivable to provide light scattering structures on the upper side of the light guide segment 34. It is also provided that the light decoupling can be conducted via a scattering reflectance layer on the side of the light guide 30 facing away from the underside of the cooktop. The scattering reflectance layer here can be produced by a scattering foil or film or roughening the surface of the light guide or printing in the desired portion of the light guide.

Figure 3:
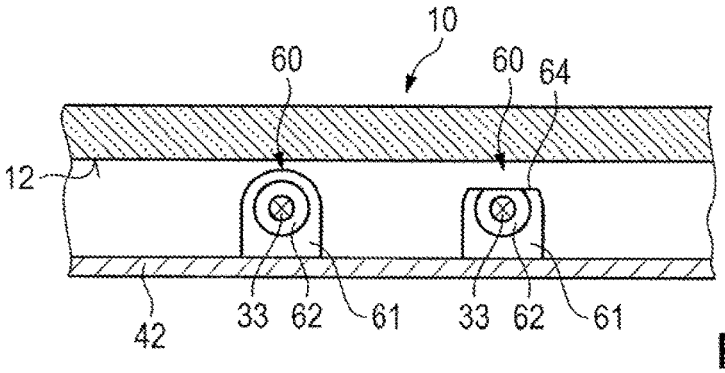
FIG. 3 shows a section detail labeled by III-III in FIG. 2.

FIG. 3 shows two different variations of a holder 60 for attaching a lighting element 30. While the fastening piece 61 of the holder 60 on the left clearly projects beyond the retaining piece 62, in the case of the holder 60 on the right, a flattening 64 is provided on the fastening piece 61, so that the retaining piece 62 preferably ends flush with the upper side of the fastening piece 61 or is only a short distance from the upper side of the fastening piece 61. The distance between the underside 12 of the cooktop 10 and the lighting element 30 can be reduced in order to provide an improved light output using the variation of a holder 60 shown at the right in FIG. 3.

Figure 4:
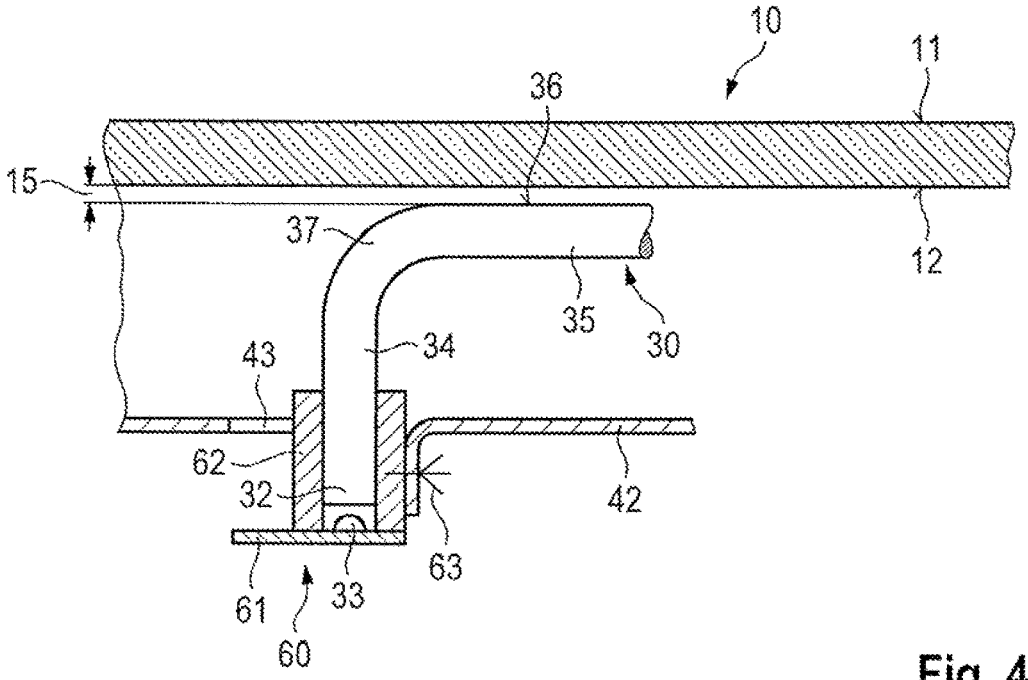
FIG. 4 shows a partial representation of a cooking apparatus in symbolized representation and lateral view.

FIG. 4 shows another variation of a holder 60. Here, the basic construction of the holder is again selected similar to that in FIGS. 2 and 3. The holder 60 again has a fastening piece 61 with an attached retaining piece 62. The support section 42 possesses a bend in the region where the connection 63 can be made to the retaining piece 62. A light guide of the lighting element 30, in the shape of a bent glass rod, a plastic rod, or a rod composed of another transparent material, is inserted into the retaining piece 62 of the holder 60. The light guide has two light guide segments 34, 35, which are disposed at an angle to one another and which are connected as one piece via an arcuate bend 37. Whereas in the embodiment variation according to FIGS. 2 and 3, the central longitudinal axis of the coupling piece 32 was aligned horizontally, in the case of FIG. 4, the longitudinal axis of the coupling piece 32 is aligned vertically to the cooktop plane. With this configuration, the lighting means 33, in particular, can be held underneath the support section 42, whereby an additional distance to the heating element and a thermal insulation are achieved. The service life of the lighting means 33 can be increased thereby.

Figure 5:
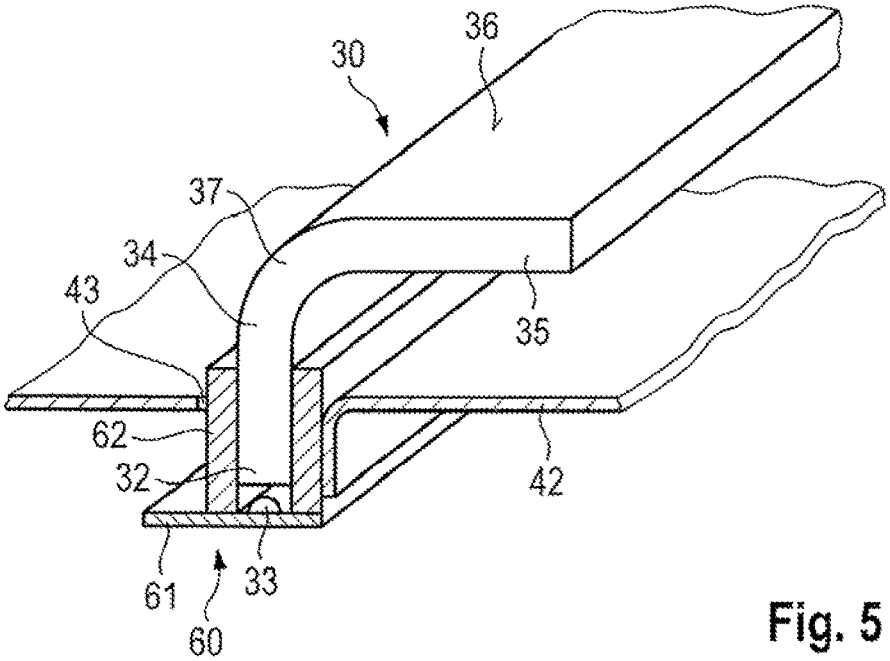
FIGS. 5-8 show different representations of lighting elements.

In principle, a construction similar to that in FIG. 4 is shown in FIG. 5. Unlike FIG. 4, a rod-shaped light guide is not employed here, but rather a light guide in the shape of a bent plate, for example, composed of glass or plastic. Again, in this case, two light guide segments 34, 35 transition into one another via a bend 37. On its upper side, the light guide segment 35 forms an emission region 36 in the shape of a rectangular or square surface, whereby the latter can also be structured, depending on the scattering or reflectance regions that are provided.

Figure 6:
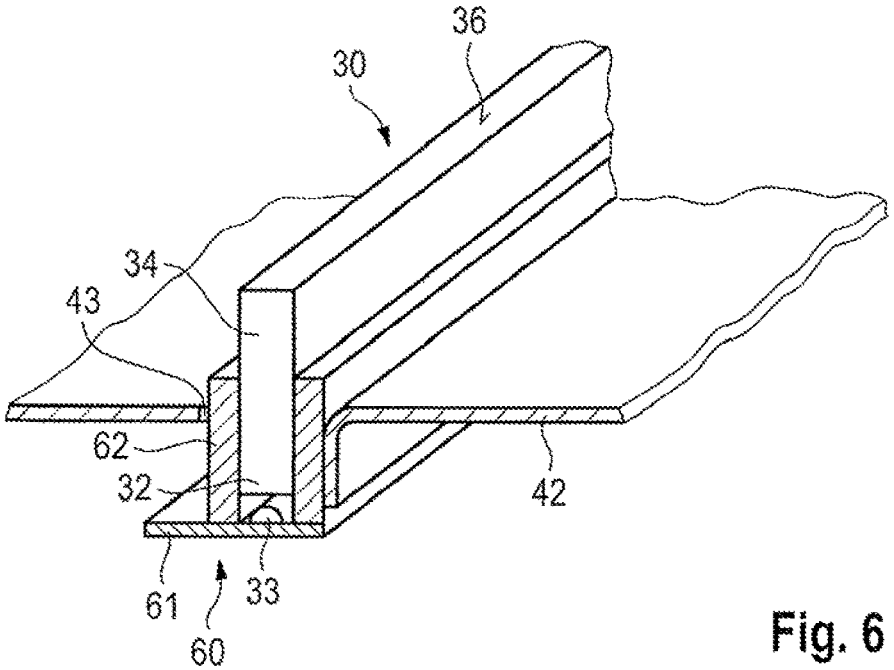

FIG. 6 shows a light guide of a lighting element 30 in the shape of a planar plate, which is set up by its coupling piece 32 in the holder 60. On its upper side, the plate forms an emission region 36 by means of which the light coupled from the lighting means is emitted. Corresponding to the plate-shaped geometry of the light guide according to FIGS. 5 and 6, the holder is also equipped with a corresponding long, extended retaining piece 62. Here, the retaining piece is formed of 2 flat surface elements running parallel at a distance from one another, between which, the coupling piece 32 is enclosed. Preferably, a plurality of lighting means is disposed next to one another in the direction of the lengthwise extension of the retaining piece 62. In this case, the lighting means 33 are preferably disposed at equal distances from one another in order to be able to achieve a uniform illumination. The equalization of the illumination can be still further improved by introducing a scattering surface at the surface of the light guide facing the lighting means. The scattering surface can be produced by roughening or printing, or in a particularly advantageous way, by using a special adhesive tape, which is sold by the 3M Company as Uniformity Tape.

FIGS. 7*a* to 7*i* show different embodiments of rod-shaped or bar-shaped light guides of a lighting element 30, wherein two light guide segments 34, 35 standing at an angle to one another are used in each case, the segments being joined together as one part via a bend.

Figure 7A:
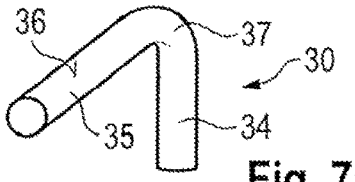
Figure 7B:
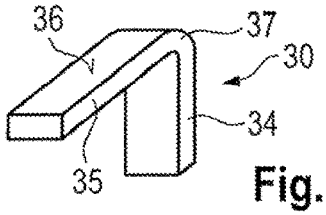
Figure 7C:
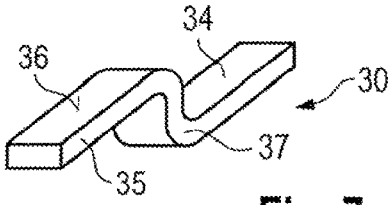
Figure 7D:
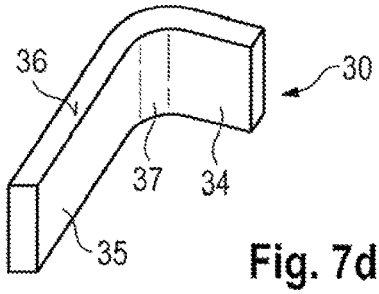
Figure 7E:
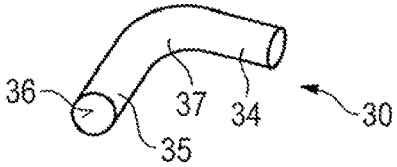
Figure 7F:
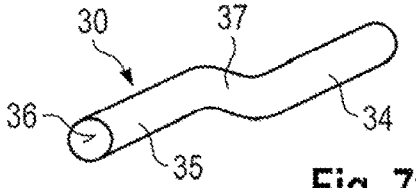
Figure 7G:
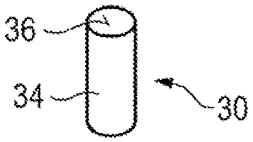
Figure 7H:
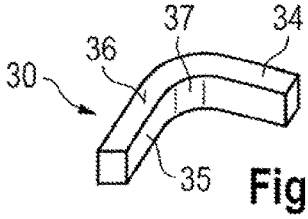
Figure 7I:
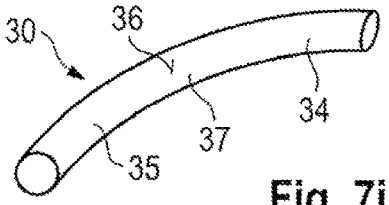

In the embodiment variation according to FIG. 7*a*, a circular cross section is selected, which makes possible the decoupling of light onto the side of the light guide facing away from the cooktop via a scattering or reflectance region. In the example of embodiment according to FIG. 7*b*, a light guide with a rectangular or square cross section is selected for this purpose. FIG. 7*c* shows a similar cross-sectional configuration of the light guide. The bend 37 is selected in this case such that the light guide segments 34, 35 stand at a small angle to one another. However, they can also be arranged parallel to one another. In the example of embodiment according to FIG. 7*d*, a rectangular cross section is selected for the light guide, wherein the height of the light guide is clearly greater than the width of the light guide. FIG. 7*e* shows an embodiment of a light guide corresponding to FIG. 4. FIG. 7*f* shows an embodiment of a light guide similar to that of FIG. 7*c*, but with a round rod-shaped cross section. FIG. 7*g* shows an embodiment variation of a cylindrical light guide. FIG. 7*h* shows a light guide which is configured similar to that of FIG. 7*d*, but has a lower height. 7*i* shows a light guide with an arcuate course.

Figure 7J:
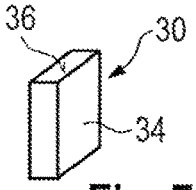
Figure 7K:
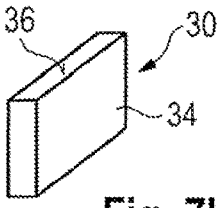

According to FIGS. 7*j* and 7*k*, light guides are also conceivable that are configured according to FIG. 6. In this way, the dimension in the longitudinal direction can vary in order to be able to create emission regions 36 of different length.

Figure 7L:
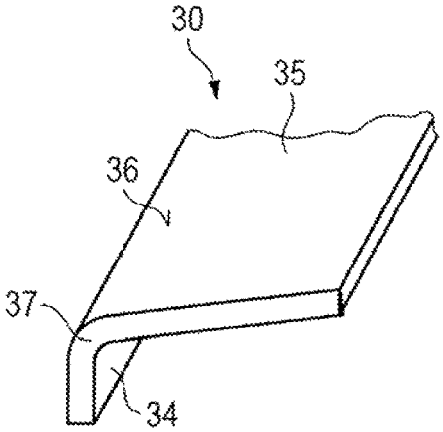
Figure 7M:
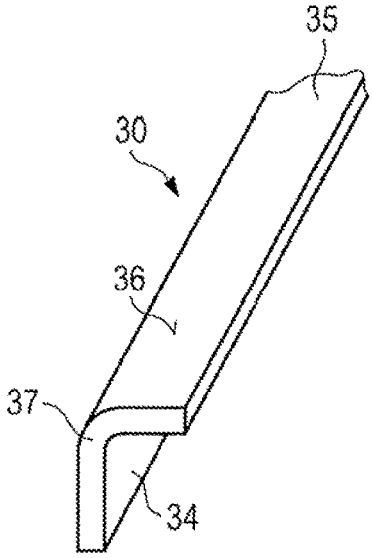

FIGS. 7*l* and 7*m* show light guides of a lighting element 30 similar to the example of embodiment according to FIG. 5. These representations illustrate that the dimension of the light guide in the directions of both width and depth may vary for variation in the geometry of the emission surface.

Figure 7N:
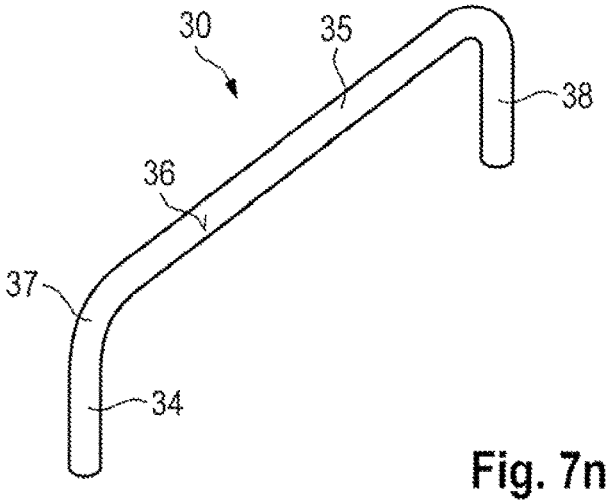
Figure 7O:
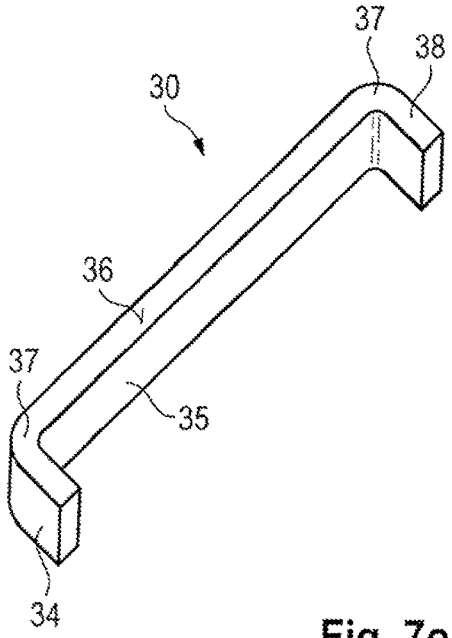
Figure 7P:
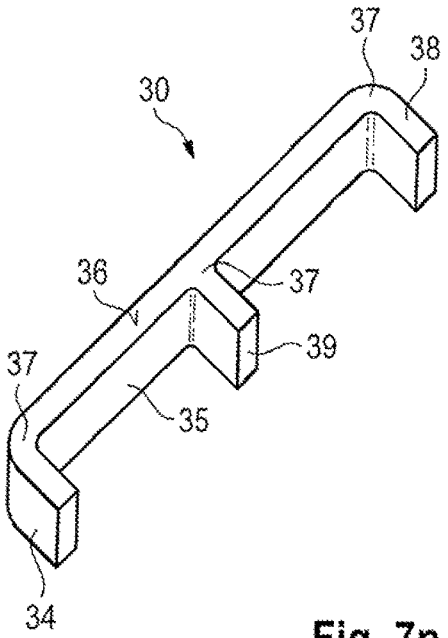

In FIGS. 7*n* to 7*p*, light guides of a lighting element 30 are disclosed, in which a plurality of light guide segments 34, 35, 38 and 39 are joined in one piece with one another. In this case, FIG. 7*n* shows an arcuate geometry of the light guide that is formed by a round rod. FIG. 7*o* shows an arcuate geometry that has a rectangular cross section. 7*p* shows a light guide configuration in which an additional light guide segment 39 terminates in the center region between the two light guide segments 34 and 38. In the embodiment examples according to FIGS. 7*n* to 7*p*, lighting means 33 can be provided on the free end regions of the light guide segments 34, 38 and 39 in order to couple their light into the light guide.

Figure 7Q:
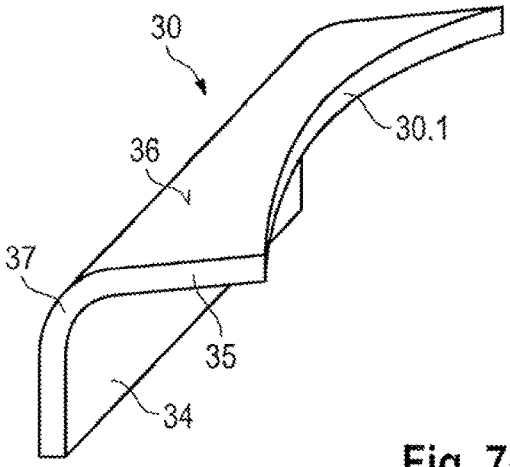

Similarly to FIG. 5, FIG. 7*q* again shows a plate-shaped light guide, wherein the light guide segment 35 has a concave geometry 30.1 on its free end in order to be able to visualize an arcuate geometry, for example the termination region of a heating element 20.

Figure 7R:
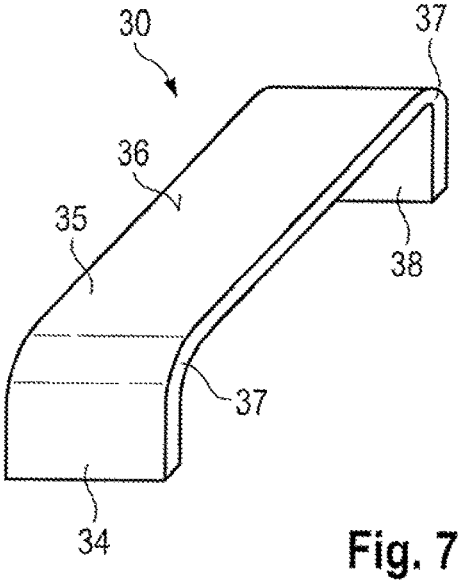

FIG. 7*r* shows a light guide which is formed by a plate-shaped blank and two leg-like light guide segments 34 and 38 that transition via bends 37 into the light guide segment 35. The light guide segment 35 in this case forms a large-area emission surface 36.

Figure 7S:
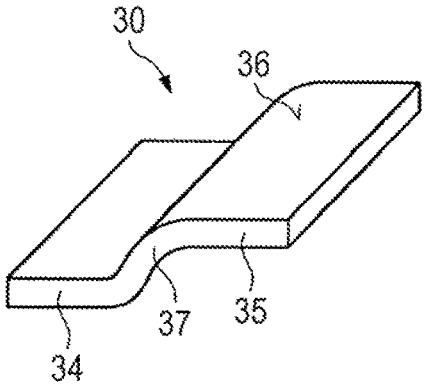
Figure 7T:
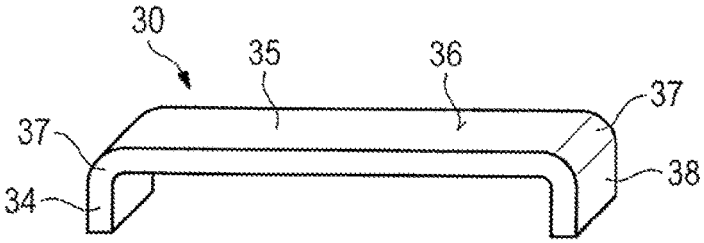
Figure 7U:
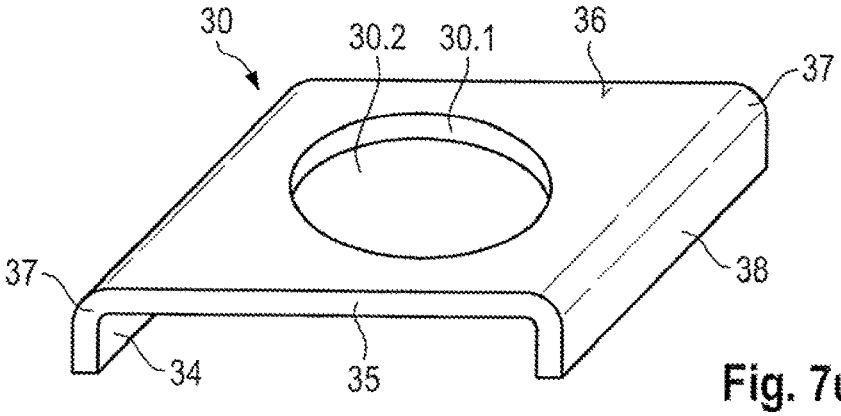

FIG. 7*s* discloses a light guide that has two plate-like light guide segments 34, 35, which transition into one another via a bend 37. In this case, the light guide segments 34, 35 are set at a small angle to one another or preferably are disposed parallel to one another. FIG. 7*t* discloses a variant that is similar to FIG. 7*r*, but in which a lesser width of the light guide segment 35 is selected, so that a correspondingly narrower emission surface 36 results FIG. 7*u* shows an example of embodiment of a light guide that has plate-like light guide segments 34, 35 and 38 that transition into one another via the bends 37. Preferably, the light guide segments 34, 38 are aligned parallel to one another. The light guide segment 35 is provided with a discontinuity or passage 30.2, which has a circular configuration, preferably corresponding to the geometry of the heating element 20. The passage 30.2 is bounded by the geometric edge 30.1.

In the case of the embodiment examples of light guides shown in FIGS. 4-7*u*, the emission regions 36 are preferably disposed parallel to the underside 12 of the cooktop 10. Of course, the emission surfaces 36 can also be at an angle to the underside 12 of the cooktop 10.

Figure 8:
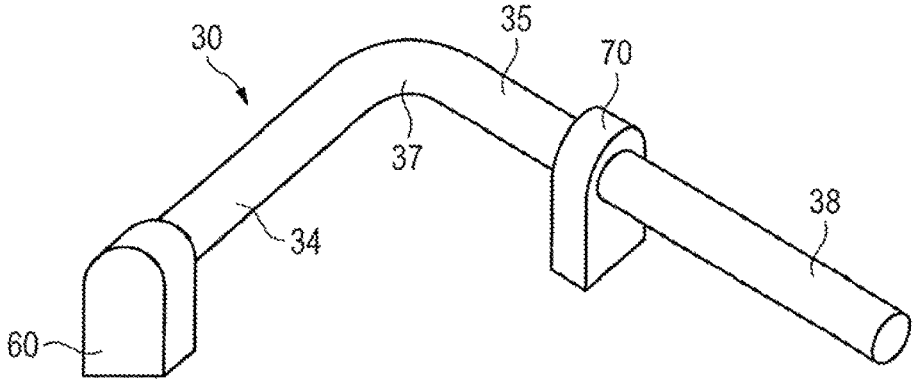

FIG. 8 discloses an example of embodiment of a lighting element 30 having a two-part shape of the light guide. In this case, first a light guide element in angular geometry is formed in one piece by the two light guide segments 34 and 35, and the bend 37. The light guide segment 34 is fastened to a holder 60, for example, corresponding to FIG. 2. The light guide segment 35 is now inserted in a holder 70. The holder 70 supports a light guide segment 38 designed as a rod profile. The light guide segments 35 and 38 are positioned in the holder 70 so that the light of the lighting element 33 coming from the light guide segment 35 can be coupled into the light guide segment 38.

Figure 9A:
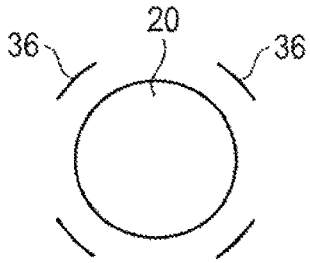
FIGS. 9*a*-10*e* show different variations of embodiment of the association of lighting elements with heating elements.
Figure 9B:
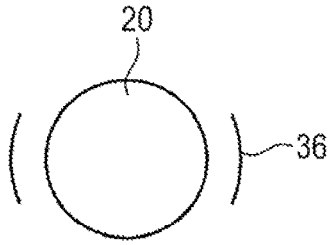
Figure 9C:
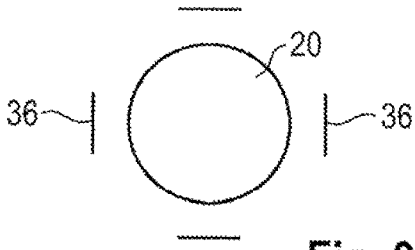
Figure 9D:
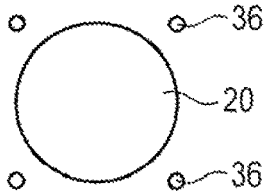
Figure 9E:
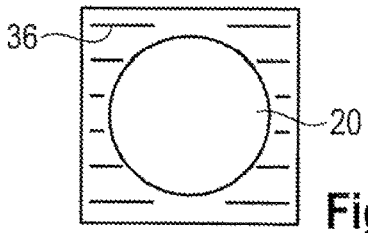

Different variations of embodiment of the invention are shown in FIGS. 9*a* to 9*e*. Thus, in these illustrations, a circular heating element 20 is symbolized, to which the emission regions 36 from lighting elements 30 are assigned. FIG. 9*a* shows four arcuate emission regions 36, which enclose the heating element 20, with the use of the light guide according to FIG. 7*i*. FIG. 9*b* likewise shows two arcuate emission regions 36 that enclose the heating element 20, with the use of the light guide according to FIG. 7*i*. FIG. 9*c* shows four linear emission regions 36, which enclose the heating element 20, wherein the light guide is used according to FIG. 7*k*. FIG. 9*d* shows four punctiform emission regions 36 from lighting means 33 that are configured with the use of the light guide according to FIG. 7*g*. An emission region 36 that can be configured with the use of the light guide according to FIG. 7*u* is shown in FIG. 9*e*.

Figure 10A:
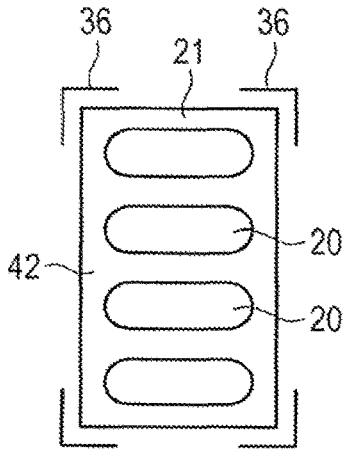
Figure 10B:
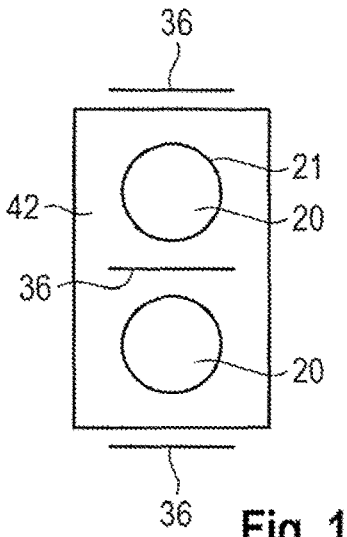
Figure 10C:
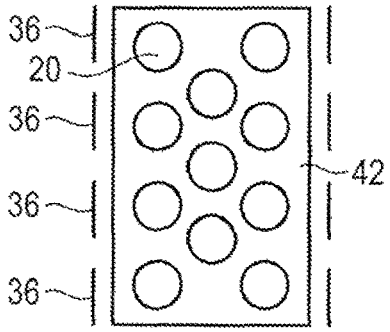
Figure 10D:
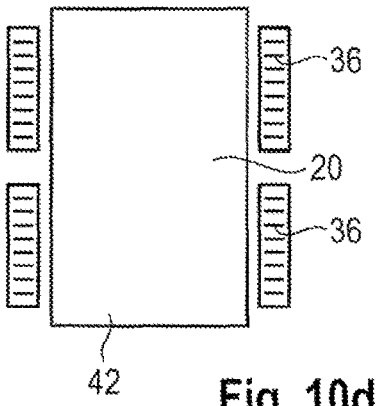
Figure 10E:
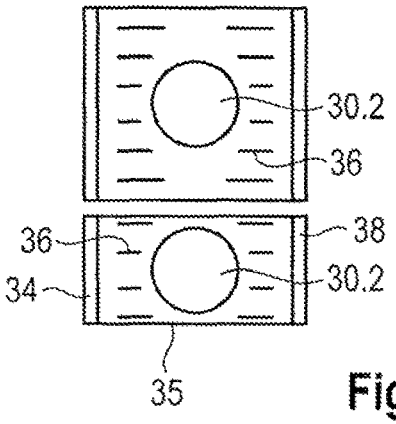

FIGS. 10*a* to 10*c* illustrate that a plurality of heating elements 20 can be installed on a support section 42. Here, different emission regions 36 can be assigned to the support section 42, in order to be able to optically label either the boundary of the support section 42 and/or to be able to optically define individual heating elements 20. As FIG. 10*a* shows, not only circular heating elements 20 in top view are usable, but also any other geometries of heating elements 20, for example, oval heating elements 20. FIG. 10*c* shows that several rows of heating elements 20 can be installed on a support section 42. FIG. 10*d* shows the rectangular configuration of a heating element 20 mounted on a support section 42. In FIG. 10*a*, light guides are used according to FIG. 7*h* or 7*e*; in FIG. 10*b*, according to FIG. 7*k* or FIG. 2; in FIG. 10*c*, according to FIG. 7*k* or FIG. 2; and in FIG. 10*c*, according to FIG. 7*m*. In expanding the structure of a light guide according to FIG. 7*u*, FIG. 10*e* shows a light guide, in which several passages 30.2 can also be introduced into the light guide segment 35.

Figure 11:
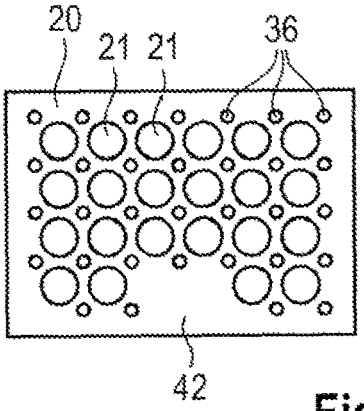
FIG. 11 shows a support section for a cooking apparatus with a plurality of heating elements in top view.
Figure 12:
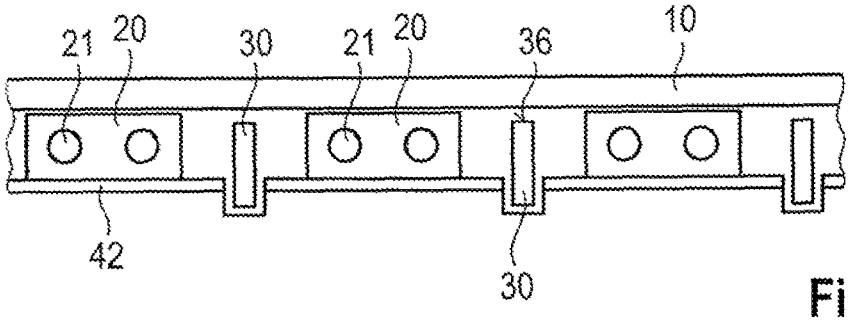
FIG. 12 shows a detail taken from FIG. 11 in schematic lateral view and in section.
Figure 13:
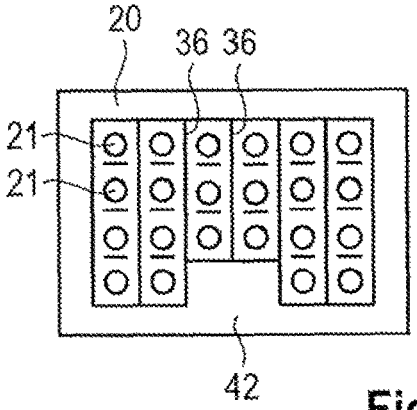
FIG. 13 shows a support section having a plurality of heating elements.

FIG. 11 shows a cooking apparatus for an induction surface application, in which a plurality of induction coils 21 of heating elements 20 are mounted on a support section 42. As FIG. 12 shows, lighting elements with light guides according to FIG. 7*g* can be disposed between the induction coils 21. Alternatively, according to FIG. 13, a linear labeling of the induction coils 21 can also be used with lighting means having light guides, for example, according to FIGS. 7*j* and 7*k*.

Figure 14:
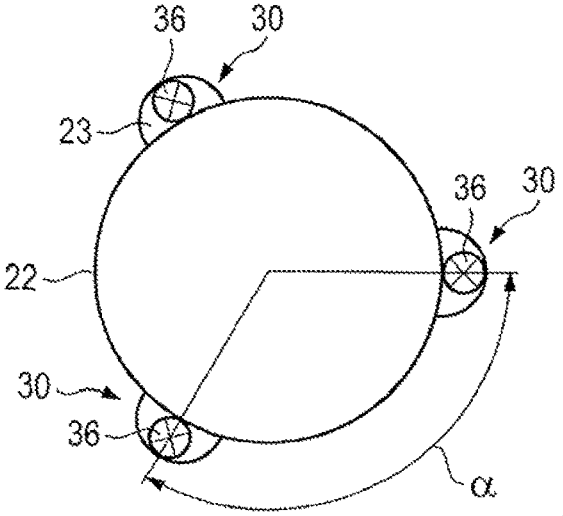
FIGS. 14-14*b* show a support for a heating element in different views.
Figure 14A:
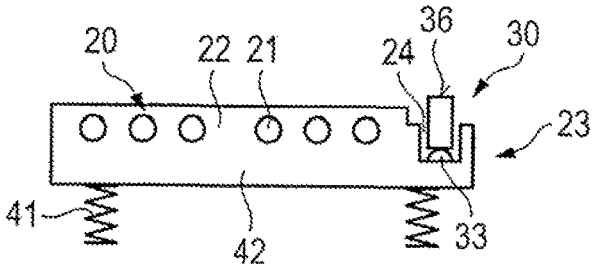
Figure 14B:
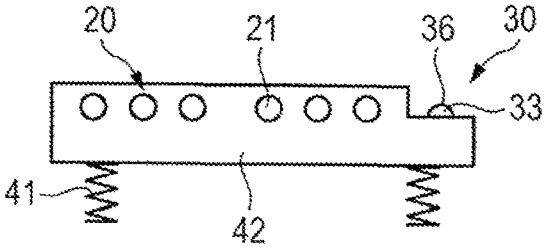

FIG. 14 shows a disk-like support 22. As FIGS. 14*a* and 14*b* show, this support takes up an induction coil 21. Projections that form uptakes 23 are formed on the support 22. Lighting means 33, which have an emission surface 36 directly for the formation of a lighting element 30 and, for example, can be designed as LEDs, are inserted into the uptakes 23 (see FIG. 14*b*). Alternatively, the lighting elements 30 according to FIG. 14*a* can also have a light guide, for example, according to FIG. 7*g*, whereby a lighting means 33, for example, an LED, is then installed in the uptake 23. The support 22 can form the support section 42, on which the spring elements 41 are supported. However, it is also conceivable that several supports 22 with their heating elements 20 are installed jointly on a support section 42, which is then supported in turn via spring elements 41. In this case, the supports 22 are preferably disposed in rows for a construction that is optimized for oscillations, in which it is particularly preferred that the supports 22 of one row are each mounted on a common support section 42, for example, in the form of a crossbar.

Figure 15:
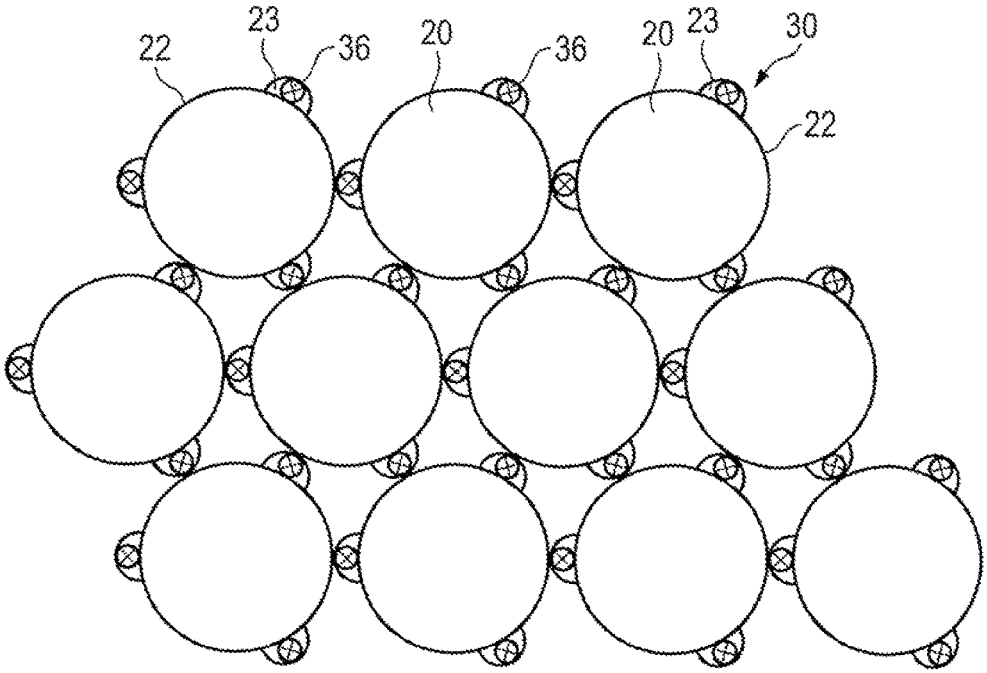
FIG. 15 shows a grid-like arrangement of supports with heating elements and lighting elements.

FIG. 15 symbolizes such a row-shaped arrangement of the supports 22 and thus of the heating elements 20. Correspondingly, three (or more) support sections 42 that are disposed next to one another and that are then each joined with the housing 50 of the cooking apparatus could find use. As FIGS. 15 and 14 depict, the uptakes 23 or the lighting elements 30 are arranged distributed at the same angular distance a to one another over the periphery of the support 22. Preferably, three uptakes 23 are provided, which are each disposed offset by 120° to one another. In this way, as FIG. 15 shows, a compact assignment of the individual heating elements 20 to one another can be achieved, and a uniform illumination of the intermediate regions between the supports 22 is made possible. Depending on the arrangement of the coils, it may also be useful to not always equip all three uptakes with lighting elements for all of the coils. It is also possible to clip the uptakes 23 onto the support and not to fix them in place, whereby a still greater flexibility arises in the arrangement of the lighting elements.

Figure 16:
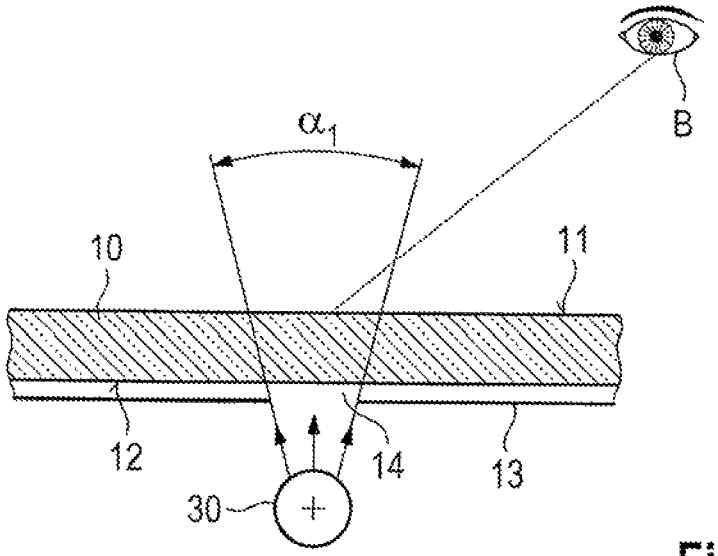
FIG. 16 shows a cooking apparatus with a masking for limiting the observation angle of a lighting effect.
Figure 17:
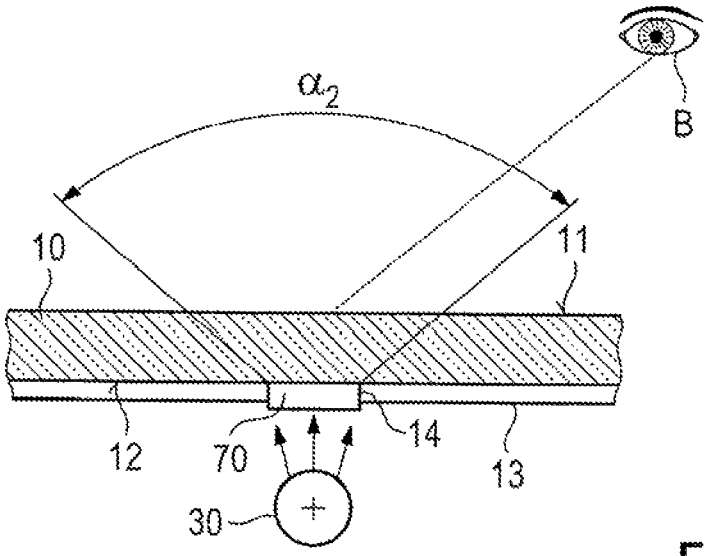
FIG. 17 shows the cooking apparatus according to FIG. 16 with a scattering element for widening the observation angle by introducing a light-scattering plane onto the underside of the cooktop.

FIGS. 16 and 17 show the cooking apparatus according to FIG. 1 in a modified embodiment, whereby, in order to improve the lighting effect on the underside 12 of the cooktop 10, a light-scattering element 70, in particular a light-scattering plane in the form of a roughening, organic or ceramic coating, a scattering foil, a scattering glass or ceramic plate, or a scattering plastic film can be introduced. The indirect support for the light-scattering layer can be joined to the underside either with an adhesive layer or self-adhesively, or loosely via pressing forces. In particular, in combination with locally limited lighting effects, which are limited, for example, via a masking on the underside 12 of the cooktop (for example, coating 13 with discontinuities 14; see above), the light-scattering plane brings about a widening of the observation angle $\alpha 1$ to provide $\alpha 2$ and a reduction in the parallax shift, whereby the recognition of this lighting effect is essentially improved for the user B.

What is claimed is:

1. A cooking apparatus comprising:

a cooktop of a glass or a glass-ceramic material, the cooktop having an underside;

a plurality of heating elements;

alighting element;

a spring-action support; and a light-scattering element connected to the underside of the cooktop, either adhesively or via pressing forces, wherein the light-scattering element causes a widening of an observation angle and a reduction in a parallax shift for a user, wherein the heating elements and the lighting element are each mounted on top of the spring-action support so that the heating elements and the lighting element are on the same plane, wherein the heating elements contact the underside of the cook-top, either directly or indirectly, and there is a gap of between 0.2 mm to 10 mm between the lighting element and the underside of the cook-top, and wherein the lighting element and the heating elements are adjusted by a deflection or oscillation of the cooktop.

2. The cooking apparatus according to claim 1, wherein when the cooktop deflects or oscillates, the spring-action support deflects or oscillates accordingly, so that the gap between the lighting element and the underside of the cooktop does not change.

3. The cooking apparatus according to claim 1, wherein the spring-action support comprises a spring that is deflected with the adjustment of the lighting element and the heating elements.

4. The cooking apparatus according to claim 1, wherein the spring-action support is elastic.

5. The cooking apparatus according to claim 1, wherein the lighting element is connected to the spring-action support by a spring.

6. The cooking apparatus according to claim 1, wherein the plurality of heating elements are in a row on the spring-action support.

7. The cooking apparatus according to claim 6, wherein the spring-action support is a plurality of supports, which extend underneath the cooktop.

8. The cooking apparatus according to claim 1, further comprising a housing that receives the heating elements and the lighting element.

9. The cooking apparatus according to claim 8, wherein the spring-action support is a disk, and comprises at least one uptake formed laterally for the lighting element.

10. The cooking apparatus according to claim 8, wherein the heating elements and the lighting element are electrified at a common electrical connection on the spring-action support.

11. The cooking apparatus according to claim 1, wherein the heating elements are two heating elements, and wherein the lighting element is between the two heating elements.

12. The cooking apparatus according to claim 1, wherein the lighting, element comprises a lighting source and a light guide having a light guide segment, into which the lighting source couples light, and the light guide segment has an emission region, over which the light of the lighting source can be emitted onto the underside of the cooktop.

13. The cooking apparatus according to claim 12, wherein the light guide segment comprises two light guide segments that transition into one another via a bend.

14. The cooking apparatus according to claim 12, wherein the emission region is formed a convex surface or a planar surface of the light guide segment.

15. The cooking apparatus according to claim 12, wherein the light guide segment is a flat surface element.

16. The cooking apparatus according to claim 12, wherein the underside of the cooktop has a knobbed structure, and the apparatus further comprises a filler layer of transparent material on the underside at least in portions of the emission region.

17. The cooking apparatus according to claim 1, wherein the cooktop has a portion with an average transmission that is >0.1% for at least one of the spectral regions from 420 to 500 nm, 500 to 550 nm, and 550 to 640 nm.

18. The cooking apparatus according to claim 17, wherein the portion has a coating.

19. The cooking apparatus according to claim 17, wherein the average transmission is >0.1%, in each case, for each of the spectral regions.

20. The cooking apparatus according to claim 17, wherein the average transmission is >0.4%.

21. The cooking apparatus according to claim 1, wherein the cooktop has a portion with a maximum transmission that is <50% in the spectral region from 400 to 750 nm and <8% in the spectral region from 450 to 600 nm.

22. The cooking apparatus according to claim 1, further comprising an optical compensation filter between an upper side of the cooktop and the lighting element.

23. The cooking apparatus according to claim 1, further comprising a light-scattering element between the lighting element and an upper side of the cooktop.

24. The cooking apparatus according to claim 1, wherein the cooktop comprises a coating on at least one of an upper side and the underside.

25. The cooking apparatus according to claim 1, wherein the plurality of heating elements or the lighting element is in heat-conducting contact with a heat sink, and wherein the heat sink is on the common support section.

26. A cooking apparatus comprising:

a cooktop of a glass or a glass-ceramic material, the cooktop having an underside;

a plurality of heating elements;

a lighting element;

a spring-action support; and a light-scattering element connected to the underside of the cooktop, either adhesively or via pressing forces, wherein the light-scattering element causes a widening of an observation angle and a reduction in a parallax shift for a user, wherein the plurality of heating elements and the lighting element are each mounted on the spring-action support so that the heating elements and the lighting element are on the same plane, wherein the heating elements contact the underside of the cooktop, and there is a gap between the lighting element and the underside of the cook-top, wherein the lighting element and the heating elements move with a deflection or oscillation of the cooktop, wherein the heating elements are in a row on the spring-action support, and wherein the spring-action support is a plurality of supports, which extend underneath the cooktop.

27. A cooking apparatus comprising:

a cooktop of a glass or a glass-ceramic material, wherein the cooktop has an underside;

a heating element;

a lighting element; and a spring-action support, wherein the heating element and the lighting element are each mounted to the spring-action support so that the heating element and the lighting element are on the same plane, wherein the heating element contacts the underside of the cooktop, either directly or indirectly, and there is a gap of between 0.2 mm to 10 mm between the lighting element and the underside of the cooktop, and wherein the lighting element and the heating element are adjusted by a deflection or oscillation of the cooktop.

* * * * *